US009788578B2

(12) United States Patent
Betts

(10) Patent No.: US 9,788,578 B2
(45) **Date of Patent: *Oct. 17, 2017**

(54) ADJUSTABLE BRA

(71) Applicant: Catherine Anne Betts, Piedmont, CA (US)

(72) Inventor: Catherine Anne Betts, Piedmont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/230,673

(22) Filed: Aug. 8, 2016

(65) Prior Publication Data

US 2016/0338420 A1 Nov. 24, 2016

Related U.S. Application Data

(63) Continuation of application No. 14/031,904, filed on Sep. 19, 2013, now Pat. No. 9,408,420.

(51) Int. Cl.
*A41C 3/00* (2006.01)
*A41F 15/00* (2006.01)

(52) U.S. Cl.
CPC ..... *A41C 3/0028* (2013.01); *A41C 3/0035* (2013.01); *A41C 3/0057* (2013.01); *A41F 15/002* (2013.01)

(58) Field of Classification Search
CPC ..... A41C 3/00; A41C 3/0021; A41C 3/0028; A41C 3/0057; A41C 3/0078; A41C 3/02; A41C 3/06; A41C 3/08
USPC ..... 450/58, 62, 69, 82, 70, 71, 73, 79, 26, 450/28, 9, 10.15–17, 30–33
See application file for complete search history.

(56) References Cited

U.S. PATENT DOCUMENTS 1,164,642 A * 12/1915 Guinzburg ..... A41C 3/08 2/54
1,254,043 A * 1/1918 James ..... A41C 3/08 450/31
1,587,672 A * 6/1926 Nightingale ..... A41C 3/08 450/30
4,797,954 A * 1/1989 Williams ..... A41B 1/08 2/106

(Continued)

FOREIGN PATENT DOCUMENTS

EP 2548461 9/1999
EP 1536705 6/2005

(Continued)

*Primary Examiner* — Gloria Hale
(74) *Attorney, Agent, or Firm* — K&L Gates

(57) ABSTRACT

The present disclosure is directed to various embodiments of an adjustable bra, or sports bra. The bra includes a front portion, side portions and a rear portion. Two straps extend between the front portion and the rear portion. The bra further includes a chest band which extends about its lower perimeter. The bra additionally includes a corset mechanism. The various embodiments of the bra disclosed herein are adjustable in at least four ways to suit any size and any activity. First, the wearer may adjust the diameter of the chest band. Second, the wearer may adjust the length of the straps. Third, the wearer may adjust the position of the straps (i.e., whether crossed). Finally, the user may adjust the corset mechanism to vary compressive forces on the breasts. In various embodiments, each of these adjustments is made from the front of bra and without requiring removal.

20 Claims, 14 Drawing Sheets

(56) References Cited

U.S. PATENT DOCUMENTS

| | | | | |
|---|---|---|---|---|
| 5,011,452 | A | 4/1991 | Kelly | |
| 5,263,202 | A * | 11/1993 | Siberell | A41F 1/00 2/158 |
| 5,378,192 | A | 1/1995 | Darmante | |
| 6,068,538 | A | 5/2000 | Alleyne | |
| 6,165,045 | A | 12/2000 | Miller et al. | |
| 7,435,155 | B2 | 10/2008 | Reinisch et al. | |
| 7,588,479 | B2 | 9/2009 | Falla | |
| 7,753,759 | B2 | 7/2010 | Pintor et al. | |
| 7,938,711 | B1 | 5/2011 | Johnston | |
| 8,128,457 | B2 | 3/2012 | Reinisch et al. | |
| 8,177,602 | B1 | 5/2012 | Kaytes | |
| 8,465,341 | B2 | 6/2013 | Shashy | |
| 9,408,420 | B2 * | 8/2016 | Betts | A41C 3/0057 |
| 2002/0029407 | A1 * | 3/2002 | Blechman | A41F 9/025 2/311 |
| 2007/0169247 | A1 * | 7/2007 | Mordecai | A62B 17/006 2/81 |
| 2011/0104985 | A1 | 5/2011 | Linder et al. | |
| 2011/0117818 | A1 | 5/2011 | Barnard | |
| 2011/0275276 | A1 | 11/2011 | Shashy | |
| 2011/0275277 | A1 | 11/2011 | Martins-Crawbuck et al. | |
| 2012/0171930 | A1 | 7/2012 | Kaufman | |
| 2012/0244782 | A1 | 9/2012 | Pundyk | |
| 2015/0079876 | A1 * | 3/2015 | Betts | A41C 3/0028 450/78 |

FOREIGN PATENT DOCUMENTS

| | | |
|---|---|---|
| EP | 0941674 | 1/2013 |
| WO | 2004002362 | 1/2004 |
| WO | 2012141768 | 10/2012 |

* cited by examiner

ADJUSTABLE BRA

PRIORITY CLAIM

This application is a continuation of U.S. Patent Application entitled "Adjustable Bra", Ser. No. 14/031,904, filed Sep. 19, 2013, issuing as U.S. Pat. No. 9,408,420, the entire contents of which are incorporated herein by reference and relied upon.

BACKGROUND

Women's bras, or sports bras, are a complex garment including many parts. Due to the wide variation in shapes and sizes of women, many times finding a properly fitting/comfortable bra can be very difficult. Providing bras in standard sizes does not always suit every woman's needs. A need therefore exists for bras which are adjustable in various ways to suit various sizes.

Further, different physical activities require different levels of breast control. For example, soccer, running, jumping, dancing, boxing or horseback riding require a relatively high level of breast control. Other activities such as shopping, lounging, hiking, meditating, yoga, bicycling or gardening require a lower level of breast control. Also, many occupations and sports require women to repeatedly raise their arms above the shoulders. Volleyball or basketball athletes for example, must continually raise their arms above their shoulders. This can cause the shoulder straps of known traditional bras to dig in. Different sports and activities require different ranges of motion and ideal strap locations. A need therefore further exists for bras which are adjustable to suit various sports and activities and with ideal tensioning and positioning of the straps.

Finally, many women seamlessly transition throughout the day from professional environments, to leisure to sporting activities. Changing clothes and adjusting one's bra throughout the day can be a hassle. A need therefore exists for bras which can be easily adjusted on the go without requiring removal.

SUMMARY

The present disclosure is directed to various embodiments of an adjustable bra, or sports bra. The bra includes a front portion that covers and supports a wearer's breasts, side portions which wrap around the wearer's side and a rear portion which at least partially covers the wearer's back. Two straps extend between the front portion and the rear portion. The bra further includes a chest band which extends about the lower perimeter of the bra. The combination of the chest band and the straps support a wearer's breasts. The bra additionally includes a corset mechanism.

Each of the embodiments of the bra disclosed herein is adjustable in at least four ways to suit any size wearer and any activity. First, the wearer may adjust the diameter of the chest band. Second, the wearer may adjust the length of the straps. Third, the wearer may adjust the position of the straps (i.e., whether crossed). Finally, the wearer may adjust the corset mechanism to vary compressive forces on the breasts. Importantly, in the various embodiments of the bra disclosed herein, each of these adjustments is made from the front of bra and without requiring removal of the bra.

Enabling a wearer to adjust the bra in at least these four ways ensures an exact fit. Further, enabling adjustment of the bra from a wearer's front without bra removal makes this bra amenable to any activity, any time of day.

Additional features and advantages are described herein, and will be apparent from the following Detailed Description and the figures.

DETAILED DESCRIPTION

Figure 1:
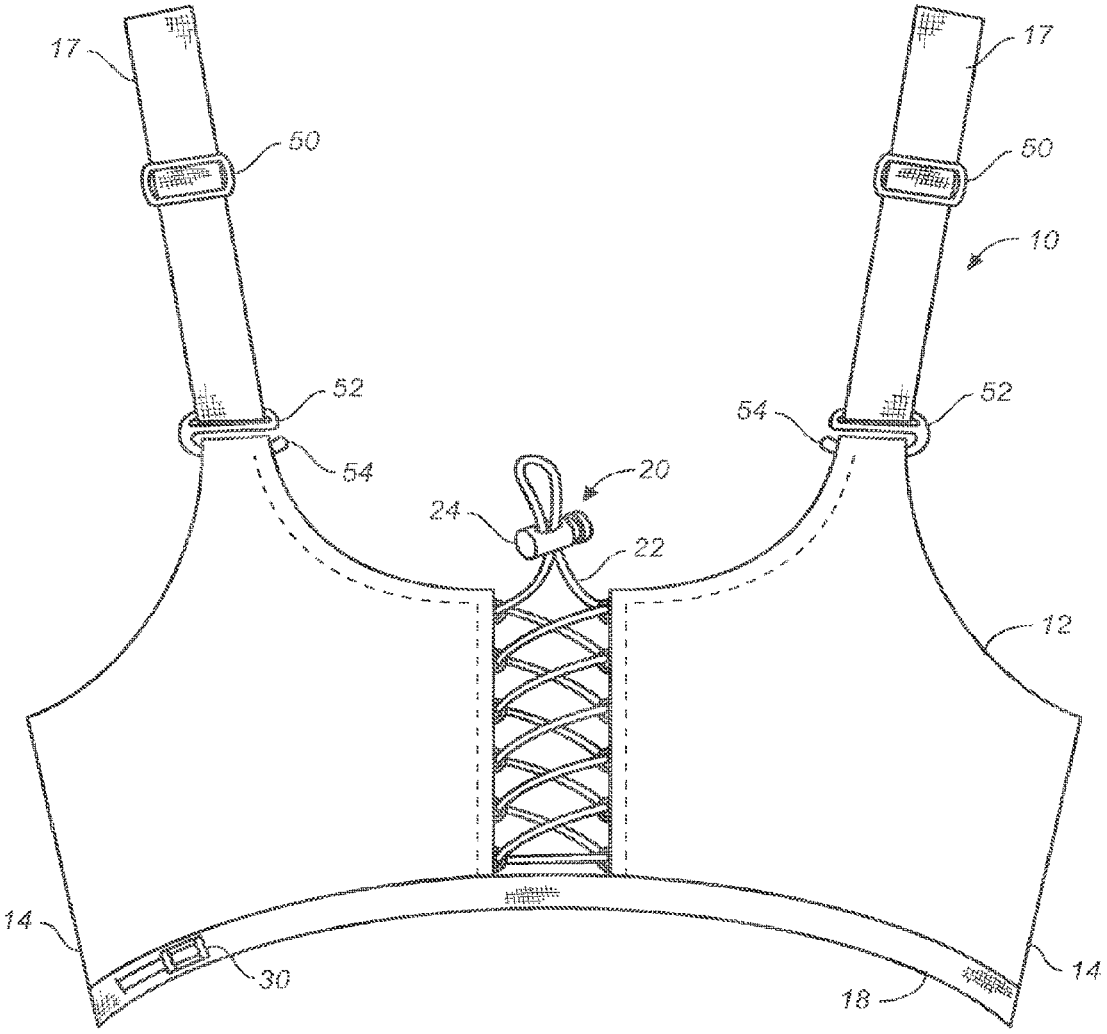
FIG. 1 illustrates a front view of a first embodiment of the bra without a front cover element and showing the straps positioned on the same side as their respective point of attachment to the rear portion of the bra.
Figure 2:
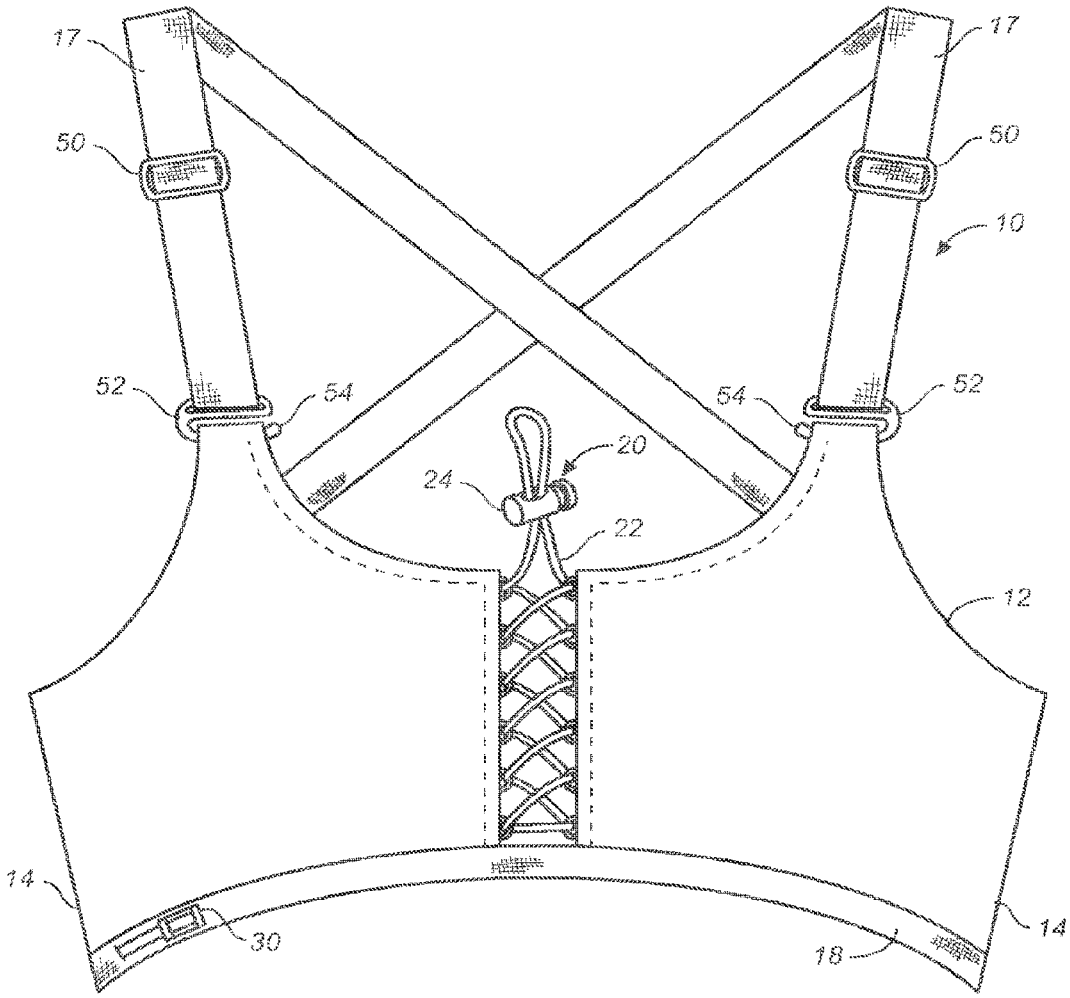
FIG. 2 illustrates a front view of the first embodiment of the bra without a front cover element and showing the straps crossed.
Figure 3:
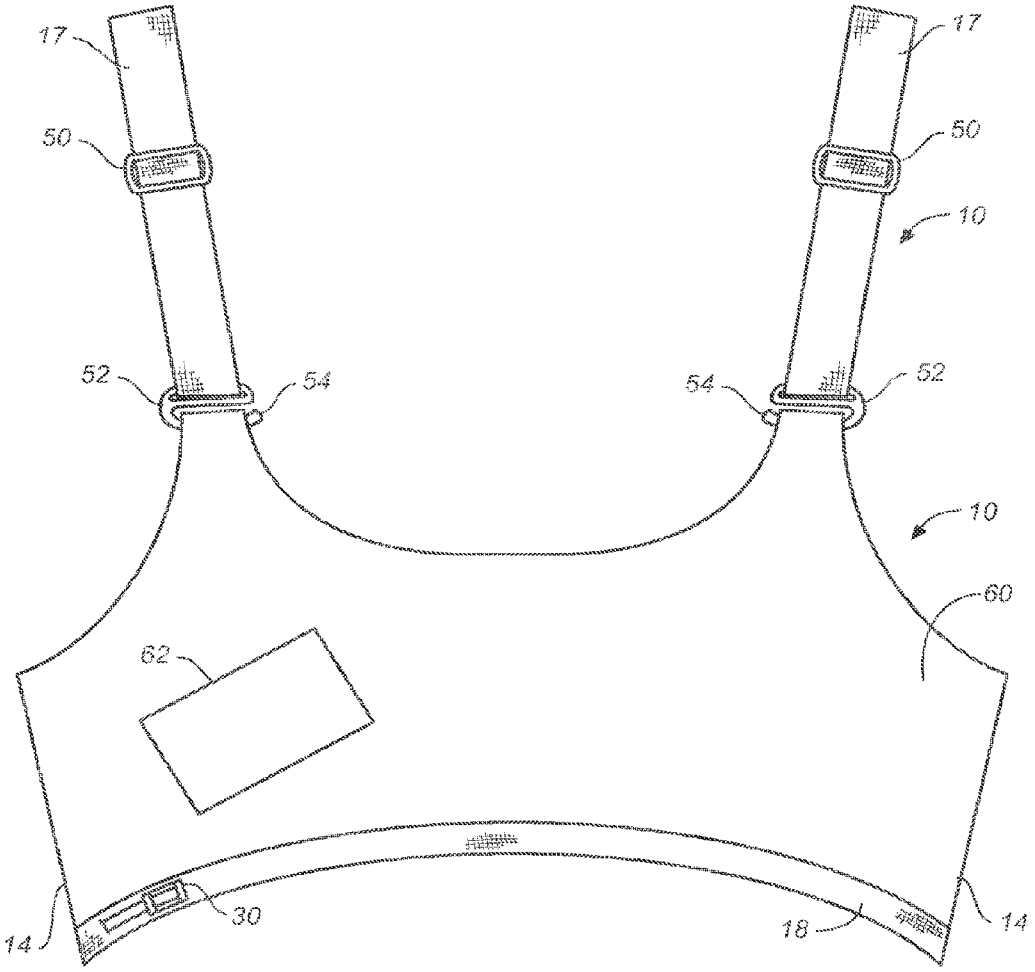
FIG. 3 illustrates a front view of the first embodiment of the bra with a front cover element and an electronic device holder and showing the straps positioned on the same side.
Figure 4:
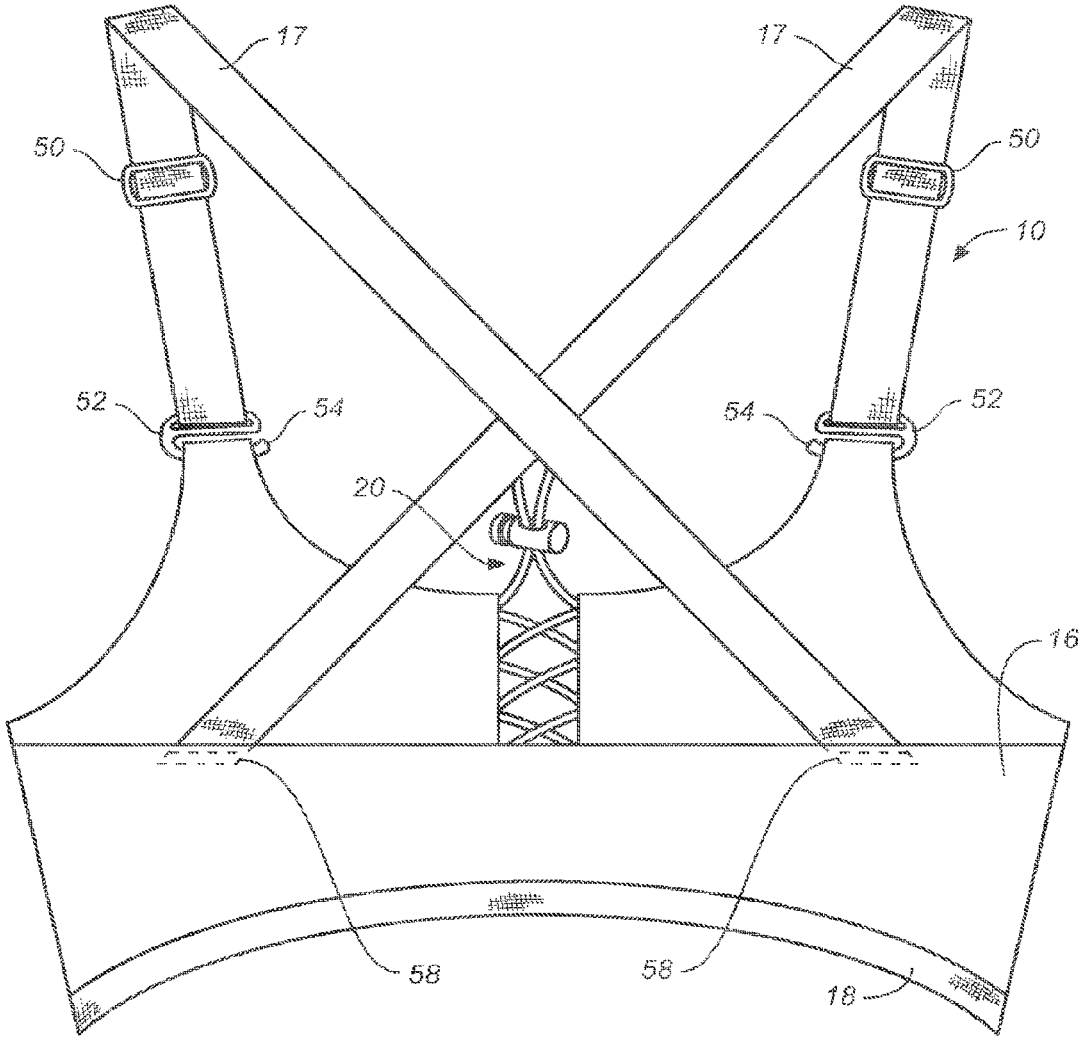
FIG. 4 illustrates a rear view of the first embodiment of the bra showing the straps crossed.

Referring now more specifically to the figures, FIGS. 1 to 4 illustrate a first embodiment of the bra 10. FIG. 1 illustrates a front view of the first embodiment of the bra 10. The bra 10 includes a front portion 12 that covers and supports a wearer's breasts, side portions 14 which wrap around the wearer's side and a rear portion 16 (as illustrated in FIG. 4) which at least partially covers the wearer's back. Two straps 17 extend between the front portion 12 and the rear portion 16. The bra 10 further includes a chest band 18 which extends about the lower perimeter of the bra 10. The combination of the chest band 18 and the straps 17 support a wearer's breasts. The bra 10 additionally includes a corset mechanism 20.

The bra 10 illustrated in FIGS. 1 to 4 is adjustable in at least four ways to suit any size wearer and any activity. First, the wearer may adjust the diameter of the chest band 18 at the front of the bra 10 without removing the bra 10 using the chest band adjustment mechanism 30. FIG. 1 illustrates chest band adjustment mechanism as being a traditional strap adjuster (discussed in more detail below relative to FIG. 11A). In various embodiments, the chest band 18 is an elastic band of suitable width and thicknesses. The chest band 18 may be made of various other suitable materials and may be provided in a variety of suitable sizes and thicknesses.

It should be appreciated that in various embodiments, the chest band 18 is fully exposed (i.e., there is no fabric or material covering any portion of the chest band 18). In various other embodiments at least a portion of the chest band 18 is covered by a material or fabric, while the portion of the chest band 18 in the vicinity of the chest band adjustment mechanism 30.

As illustrated in FIG. 1, the user may adjust the length of the straps 17 at the front of the bra 10 without removing the bra 10. In various embodiments, the length of each strap is adjusted using a traditional strap adjuster 50. It should be appreciated that in various embodiments, the length of the straps 17 may be adjusted using any mechanism deemed suitable by one of skill in the art. A closer view of strap adjuster 50 is provided at FIG. 12A.

As further illustrated in FIG. 1, the wearer may adjust the position of the straps 17 (i.e., whether crossed) from the front of bra 10 without removing the bra 10. In this embodiment, each strap is attached to the front portion of the bra using attachment element 52. A closer view of attachment element 52 is provided at FIG. 12B. Attachment element 52 includes a hook portion 54 that is configured to engage with an opening 56 built into the construction of the front portion 12 of the bra. A wearer is able to reverse the location of the straps by removing the hook portion 54 from the opening 56 on each side of the bra, crossing the straps over their shoulders and reattaching the straps on the other respective side of the bra. FIG. 2 provides a front view of the first embodiment of the bra in which the straps 17 are crossed. Depending on the activity, positioning the straps in the configurations of each of FIGS. 1 and 2 has independent benefits. It should be appreciated that in various embodiments, any removable attachment apparatus suitable for this application may be used to removably attach straps 17 to the front portion 12 of the bra 10.

It should be appreciated that in various embodiments, the underside of straps 17 may include padding, a non-stick material or a material that does indeed keep the strap in position relative to the skin. It should be further appreciated that any such materials or padding may extend about the entire underside of the shoulder strap or just in the area of the shoulder. In other embodiments, both sides of the should straps may be covered in such a material, in the even a shoulder strap rotates during use.

Referring still to FIGS. 1 and 2, corset mechanism 20 in this embodiment includes a cord 22 and a cord lock 24. Cord 22 and cord lock 24 are similar to those found on large bags and back packs. The cord 20 is laced through openings provided in the front portion 12 of the bra 10. As illustrated, a user may adjust corset mechanism 20 at the front of the bra 10. Tightening the corset mechanism 20 causes the front portion of the bra 12 to compress tighter against the breasts, a feature which is beneficial for certain sports and activities. For example, on the way to a sporting match, a wearer may desire a loose fit right before the match begins and a tighter fit once the match begins. Such a tighter fit is instantly available by tightening the corset mechanism. Such an adjustment may be desirable, for example, at a soccer, basketball or tennis game. Additionally, studies are showing the importance of allowing breasts to move freely without too much restriction when restriction is not necessary. The corset mechanism, independently and in conjunction with other features, will allow a user to adjust for just the right amount of support during high intensity exercise, but for natural movement when less support is needed. The claimed bra eliminates the need for generically specified margins of compression (e.g., high, medium or low) as in many existing products. Rather, the compression can be individually specified depending on the activity. Further, tightening of the corset mechanism may also enhance the appearance of a wearer's cleavage.

In the illustrated embodiment, the cord lock 24 is found at the top of the corset mechanism 20 and is designed to rest in the cleavage area of the wearer. It should be appreciated that in various other embodiments, the orientation of the cord lock 24 may be reversed and the cord lock 24 may be found at the bottom of the front portion 12 of the bra, extending past or over the outside of the chest band 18. It should be appreciated that the corset mechanism 20 could in various embodiments be a different structure. In various embodiments, the illustrated corset mechanism could be replaced by a non-elastic laced string or ribbon which is manually tied by a wearer after being tightened or loosened to an appropriate compression. In various other embodiments, the corset mechanism could include other suitable tightening elements.

As discussed above, enabling a wearer to adjust the bra in at least these four ways ensures an exact fit. Further, enabling adjustment of the bra from a wearer's front without bra removal makes this bra amenable to any activity, any time of day. For example, if a wearer were to arrive at a cross-training or "boot camp" exercise class involving unexpected activities such as jump roping, the wearer may quickly make adjustments to the bra to support any such activity involving lots of movement without having to take their shirt off. In turn, the bra may be subsequently loosened just as easily.

Referring now to FIG. 3, in various embodiments, the bra 10 includes a front cover element 60 that is configured to cover the front portion of the bra 12, including the exposed corset mechanism 20. As illustrated, the corset mechanism 20 is not visible in this embodiment. It should be appreciated that in various embodiments, the front cover element 60 may be the same or a different material from other parts of the bra. It should also be appreciated that the front cover element may be attached to the front portion 12 of the bra in multiple ways, including by Velcro, by snaps, by buckles, by clips or by various other suitable methods.

In various embodiments, certain portions of the front cover element 60 are permanently attached to the front portion 12 of the bra 10 and others are removable to allow adjustment of the corset mechanism 20. For example, in one embodiment, the front cover element is attached to the front portion 12 of the bra just above the chest band 18 and along the side portions 14 of the bra. However, the front cover element is not attached to the top of the front portion of the bra 10. Rather, the top portion of the cover element 60 may be configured to engage with the attachment element 52 or another portion of the front portion of the bra 12.

It should be appreciated that in various other embodiments, the front cover element 60 is permanently attached to the bra 10 and the front portion 12 is simply the inner portion of two layers of the front of the bra 10. In this embodiment, the cover element 60 is configured and sized such that the wearer can easily access and adjust the corset mechanism 20.

Referring still to FIG. 3, in this embodiment, the bra 10 includes an electronic device holder 62. Wearer's may utilize holder 62 for a music player, phone or other electronic device. It should be appreciated that in various embodiments, holder 62 could be located at any suitable location on bra 10. It should further be appreciated that in various embodiments, holder 62 may be lined with or composed of a material which guards against transmission of harmful radio waves or electronic signals from a housed electronic device. Further, it should be appreciated that in various embodiments, holder 62 may be the same or a different material than other parts of bra 10.

FIG. 4 provides a rear view of the first embodiment of bra 10. As illustrated, rather than being removably attached as in the front of the bra 10, the straps 17 are fixedly attached by stitching at attachment points 58 to the rear portion 16 of the bra 10. A closer view of point of attachment 58 is illustrated at FIG. 12C. In the embodiment of FIG. 4, the top of the rear portion 16 is lower than the top of the front portion 12. This requires that straps 17 are long enough to accommodate this difference in relative height.

Figure 12A:
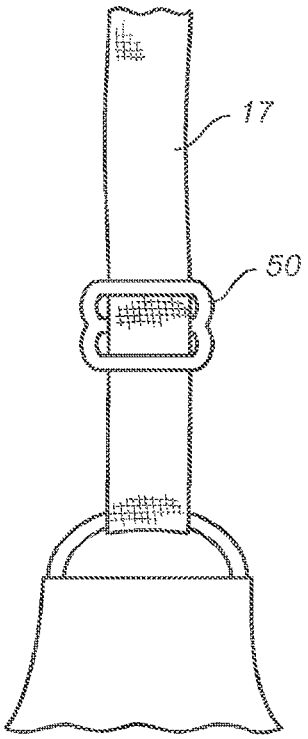
FIGS. 12A to 12C illustrate various ways of attaching the straps to either of the front portion or rear portion of the various embodiments of the bra.
Figure 12B:
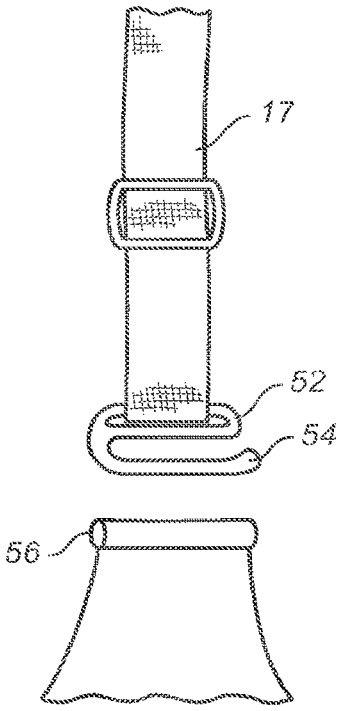
Figure 12C:
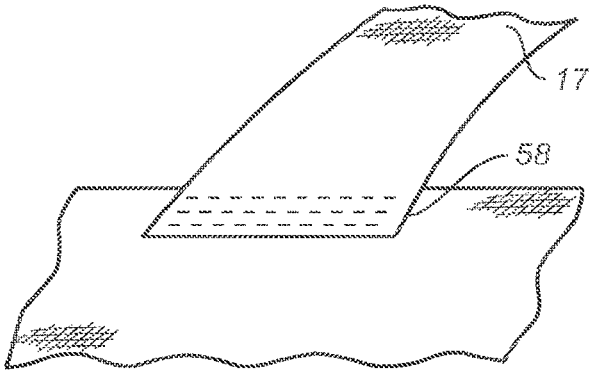

It should be appreciated that in various embodiments where the strap 17 is fixedly attached to the rear portion 16 of the bra, instead of the strap 17 being stitched directly to the rear portion 16 of the bra at point of attachment point 58, the strap 17 may alternatively be attached to a plastic or metal ring that is attached to the rear portion 16 of the bra, as illustrated in FIG. 12A.

It should be appreciated that in FIGS. 1 to 4, the front portion 12, side portion 14, rear portion 16 and possible cover material of the chest band may be made of the same material or combination of materials. It should be appreciated that in various other embodiments, different portions of bra 10 may be made of different materials or combinations of materials. It should be further appreciated that straps 17 may be made of the same or different materials than other portions of bra 10. In various embodiments, the straps may be a less elastic material than other portions of the bra to provide the requisite support.

Figure 5:
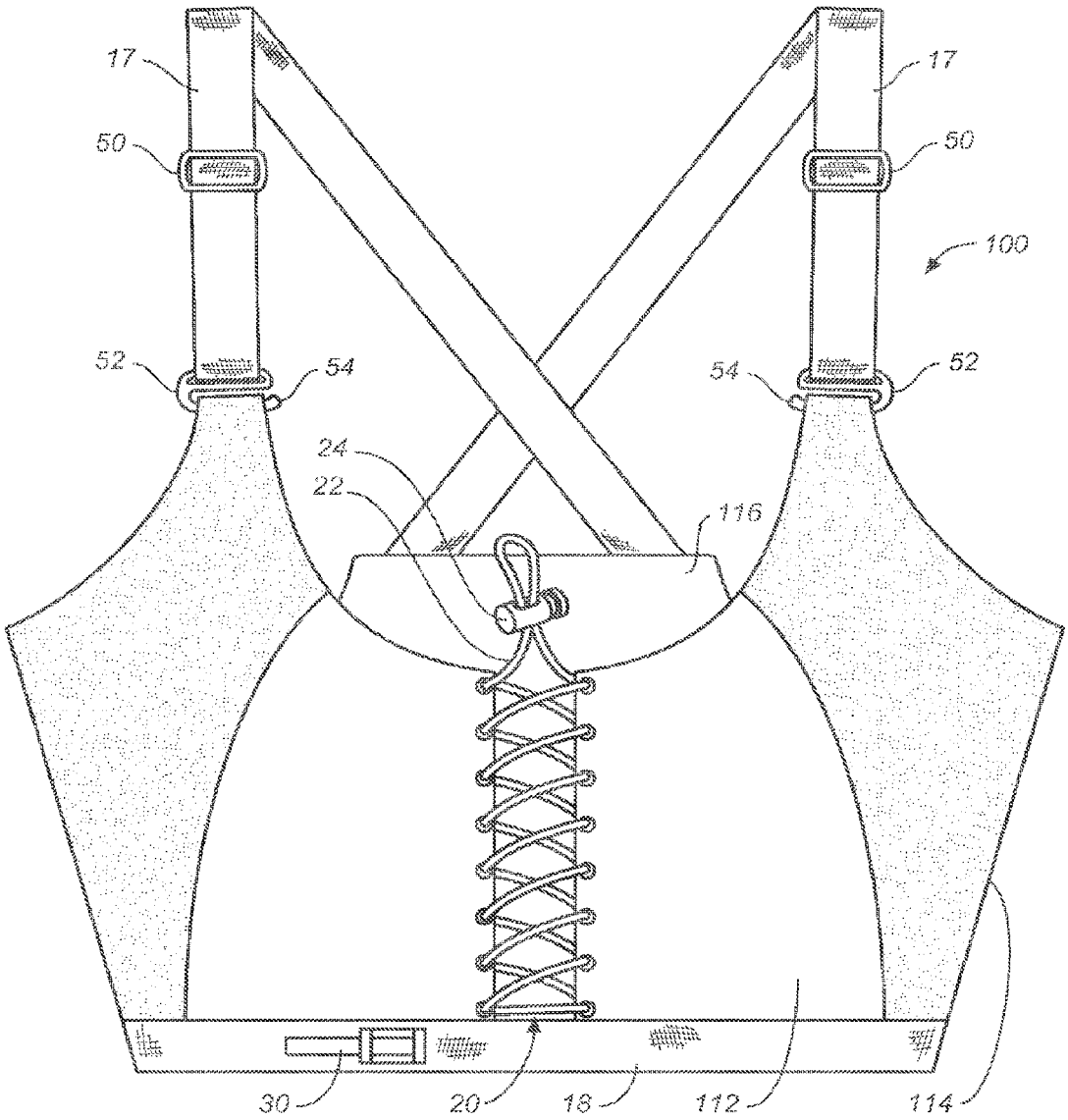
FIG. 5 illustrates a front view of a second embodiment of the bra without a front cover element and showing the straps crossed.
Figure 6:
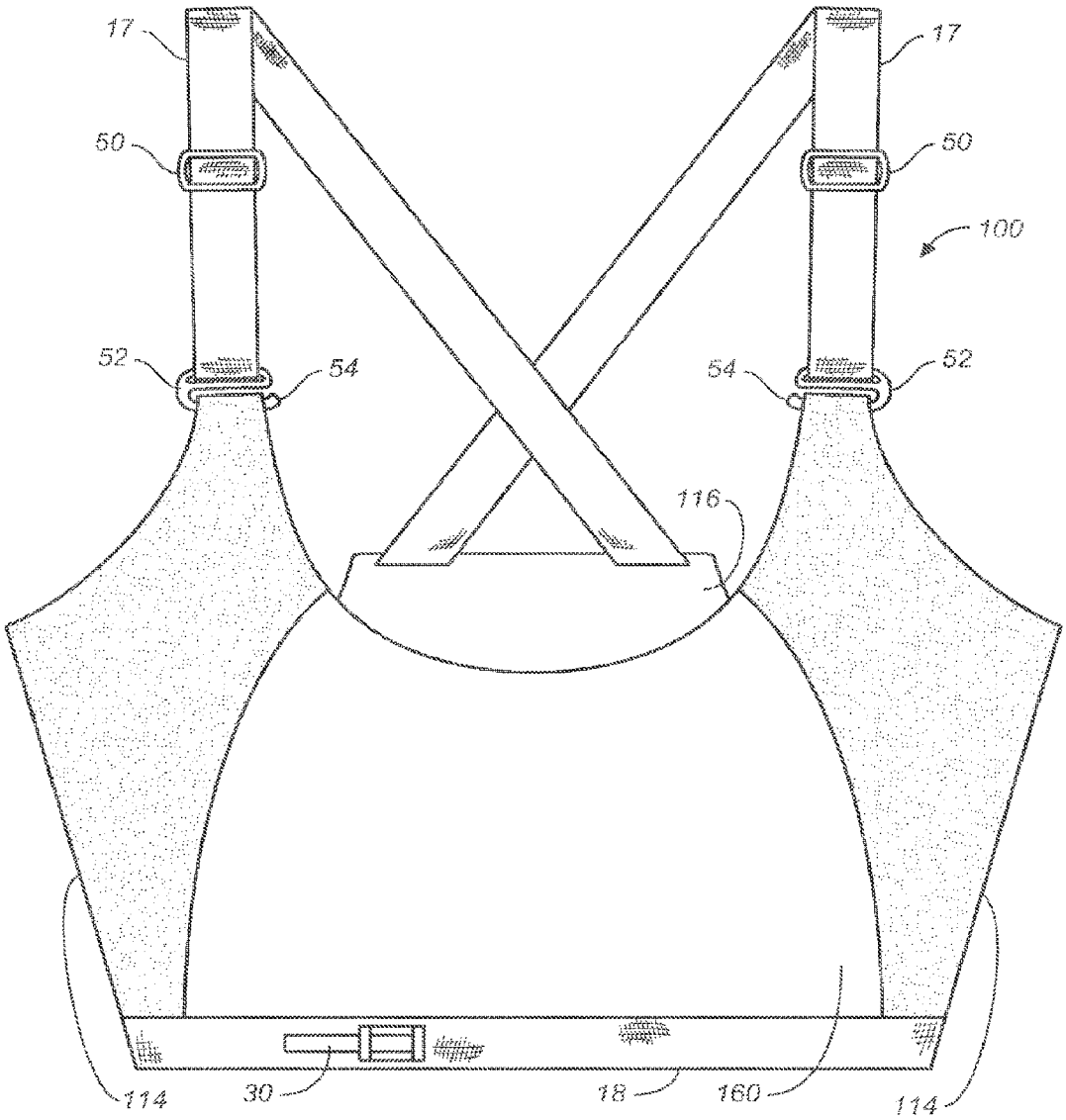
FIG. 6 illustrates a front view of the second embodiment of the bra with a front cover element and showing the straps crossed.
Figure 7:
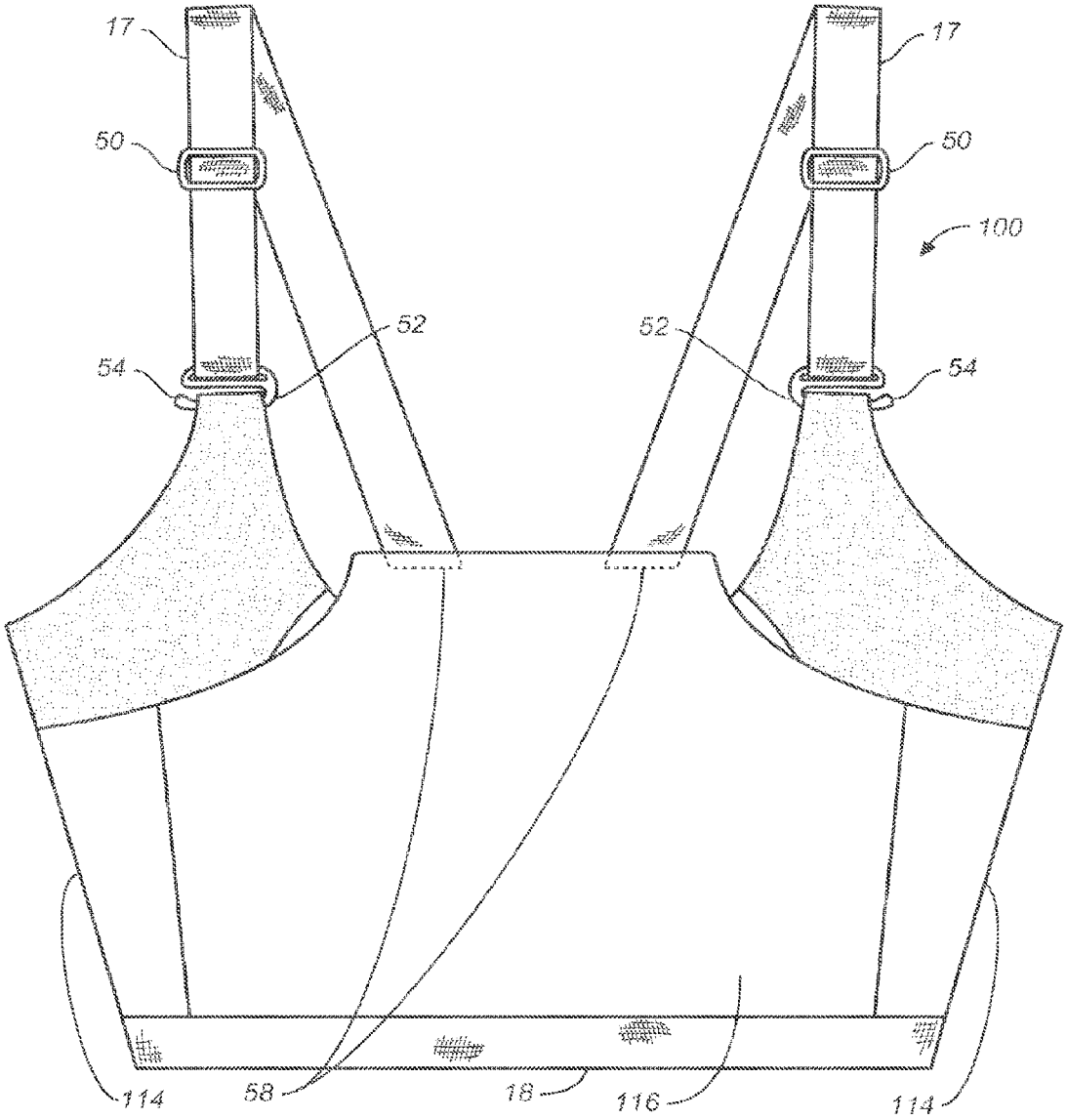
FIG. 7 illustrates a rear view of the second embodiment of the bra showing the straps positioned on the same side as their respective point of attachment to the rear portion of the bra.

FIGS. 5 to 7 illustrate a second embodiment of the bra 100. FIG. 5 illustrates a front view of bra 100. The bra 100 includes a front portion 112 that covers and supports a wearer's breasts, side portions 114 which wrap around the wearer's side and a rear portion 116 which at least partially covers the wearer's back. As in the case of the first embodiment, two straps 17 extend between the front portion 112 and the rear portion 116. The bra 100 also includes a chest band 18 which extends about the lower perimeter of the bra 100. The combination of the chest band 18 and the straps 17 support a wearer's breasts. The bra 100 additionally includes a corset mechanism 20.

The bra 100 illustrated in FIGS. 5 to 7 is adjustable just as the bra 10 of FIGS. 1 to 4 in at least four ways to suit any size wearer and any activity. First, the wearer may adjust the diameter of the chest band 18 at the front of the bra 100 without removing the bra 100 using the chest band adjustment mechanism 30.

Further, as illustrated in FIG. 5, the user may adjust the length of the straps 17 at the front of the bra 100 without removing the bra 100 using strap adjusters 50. As further illustrated in FIG. 5, the wearer may adjust the position of the straps 17 (i.e., whether crossed) from the front of bra 100 without removing the bra 100. In this embodiment, each strap is attached to the front portion of the bra using attachment element 52. Still referring to FIG. 5, corset mechanism 20 in this embodiment includes a cord 22 and a cord lock 24, as in bra 100 of FIGS. 1 to 4.

The most notable difference between bra 10 of FIGS. 1 to 4 and bra 100 of FIGS. 5 to 7 is the use of different materials for the side portion 114 and front portion 112 of the bra 100 (as well as the height of the back portion of the bra). In various embodiments, the side portion 114 and the front portion 112 of the bra may use materials of varying elasticity to provide different support and torsion properties for a wearer.

Referring now to FIG. 6, in various embodiments, the bra 100 includes a front cover element 160 that is configured to cover the front portion of the bra 112, including the exposed corset mechanism. As illustrated, the corset mechanism is not visible in this embodiment. In this embodiment, the front cover element 160 is additionally a different material than the side portions 114. It should be appreciated that in this embodiment, the front cover element 160 is the same material as the rear portion 116. It should be appreciated that in various embodiments, each of the side portions 114, front portion 112, rear portion 116 and front cover element 160 may be any combination of the same or different materials. It should also be appreciated that the front cover element may be attached to the front portion 112 of the bra in multiple ways, including by stitching, Velcro, by snaps, by clips or by various other methods.

In various embodiments, certain portions of the front cover element 160 are permanently attached to the front portion of the bra 112 and others are removable to allow adjustment of the corset mechanism 20. It should also be appreciated that in various other embodiments, the front cover element 160 is permanently attached to the bra 100 and the front portion 112 is simply the inner portion of two layers of the front of the bra 100. In this embodiment, the cover element 160 is configured and sized such that the wearer can easily access and adjust the corset mechanism 20.

FIG. 7 provides a rear view of the second embodiment of bra 100. As illustrated, rather than being removably attached as in the front of the bra 100, the straps 17 are fixedly attached by stitching at attachment points 58 to the rear portion 116 of the bra 100. In the embodiment of FIG. 7, the top of the rear portion 116 is higher than the top of the front portion 112. In various embodiments, such a configuration may allow for more breast support than other embodiments. This requires that straps 17 are the appropriate length to accommodate this difference in relative height.

Figure 8:
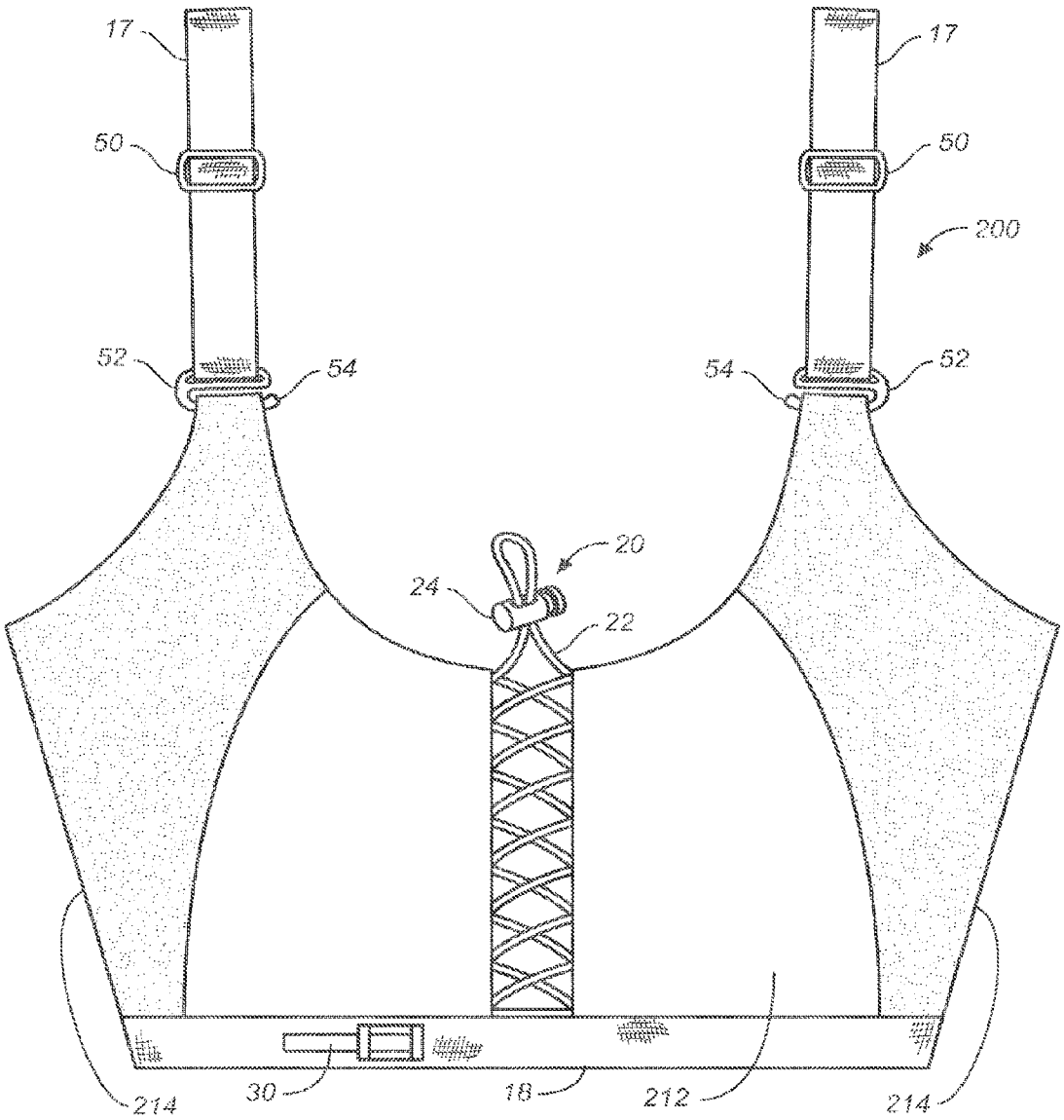
FIG. 8 illustrates a front view of a third embodiment of the bra without a front cover element and showing the straps positioned on the same side as their respective point of attachment to the rear portion of the bra.
Figure 9:
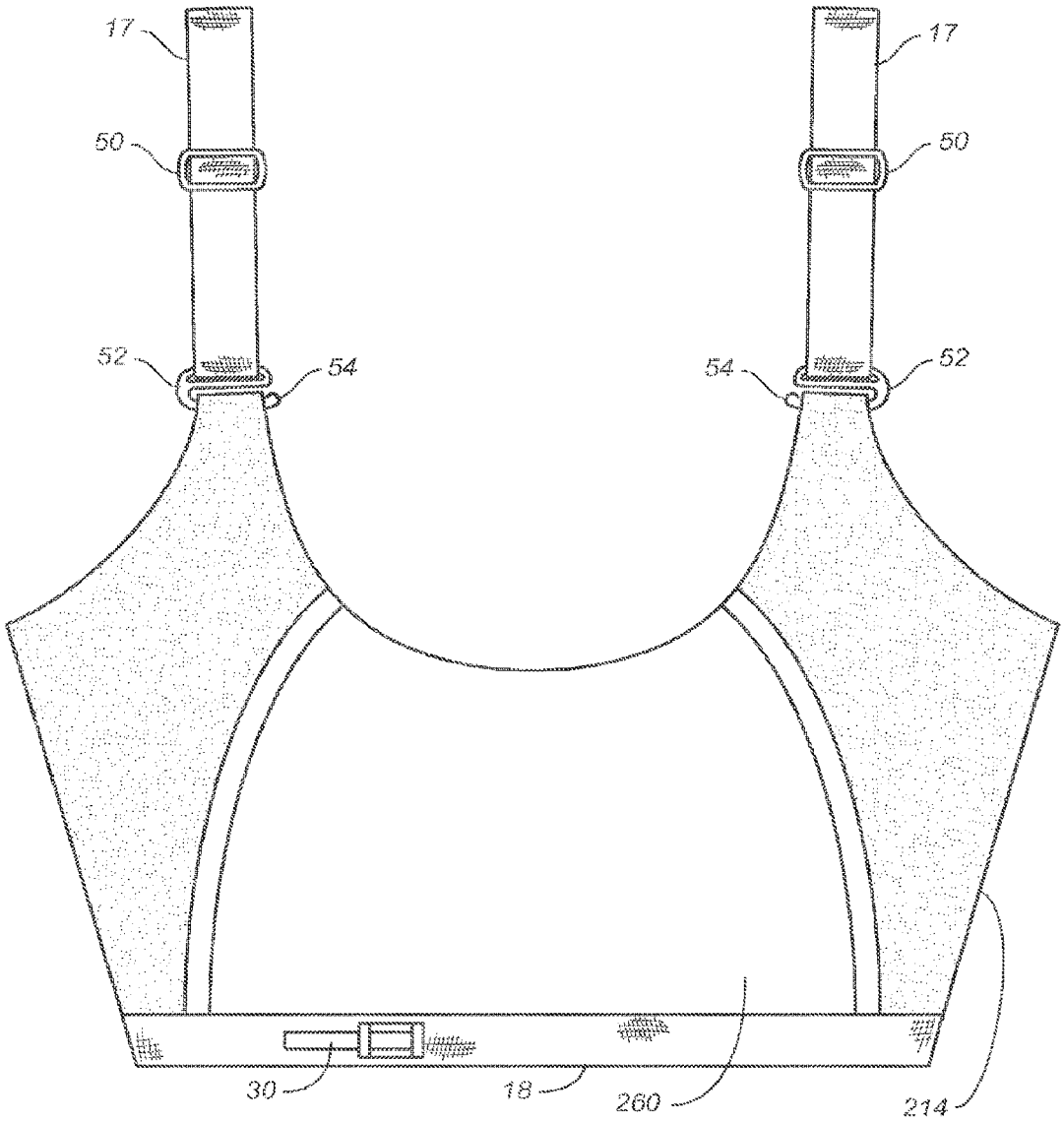
FIG. 9 illustrates a front view of the third embodiment of the bra with a front cover element and showing the straps positioned on the same side as their respective point of attachment to the rear portion of the bra.
Figure 10:
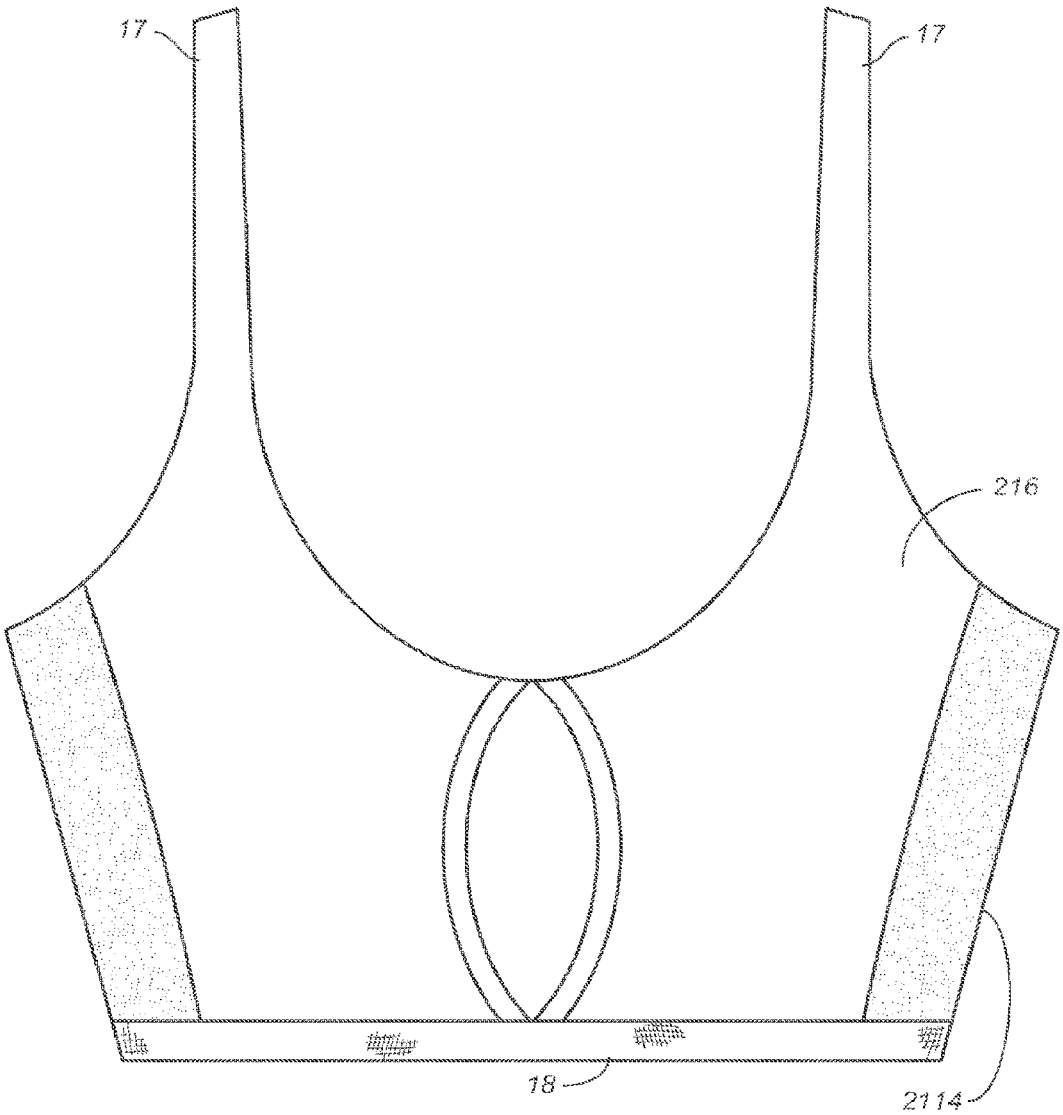
FIG. 10 illustrates a rear view of the third embodiment of the bra showing the straps positioned on the same side as their respective point of attachment to the rear portion of the bra.

FIGS. 8 to 10 illustrate a third embodiment of the bra 200. FIG. 8 illustrates a front view of bra 200. The bra 200 includes a front portion 212 that covers and supports a wearer's breasts, side portions 214 which wrap around the wearer's side and a rear portion 216 (shown in FIG. 10) that at least partially covers the wearer's back. As in the case of the first and second embodiment, two straps 17 extend between the front portion 212 and the rear portion 216. The bra 200 also includes a chest band 18 which extends about the lower perimeter of the bra 200. The combination of the chest band 18 and the straps 17 support a wearer's breasts. The bra 200 additionally includes a corset mechanism 20.

The bra 200 illustrated in FIGS. 8 to 10 is adjustable just as the bra 10 of FIGS. 1 to 4 in at least four ways to suit any size wearer and any activity. First, the wearer may adjust the diameter of the chest band 18 at the front of the bra 200 without removing the bra 200 using the chest band adjustment mechanism 30.

Further, as illustrated in FIG. 8, the user may adjust the length of the straps 17 at the front of the bra 200 without removing the bra 200 using strap adjusters 50. As further illustrated in FIG. 8, the wearer may adjust the position of the straps 17 (i.e., whether crossed) from the front of bra 200 without removing the bra 200. In this embodiment, each strap is attached to the front portion of the bra using attachment element 52. Still referring to FIG. 5, corset mechanism 20 in this embodiment includes a cord 22 and a cord lock 24, as in bra 10 of FIGS. 1 to 4.

One notable difference between bra 10 of FIGS. 1 to 4 and bra 200 of FIGS. 8 to 10 is the use of different materials for the side portion 214 and front portion 212 of the bra 200. In various embodiments, the side portion 214 and the front portion 212 of the bra may use materials of varying elasticity to provide different support and torsion properties for a wearer.

Referring now to FIG. 9, in various embodiments, the bra 200 includes a front cover element 260 that is configured to cover the front portion of the bra 212, including the exposed corset mechanism. As illustrated, the corset mechanism is not visible in this embodiment. In this embodiment, the front cover element 260 is additionally a different material than the side portions 214. It should be appreciated that in this embodiment, the front cover element 260 is the same material as the rear portion 216. It should be appreciated that in various embodiments, each of the side portions 214, front portion 212, rear portion 216 and front cover element 260 may be any combination of the same or different materials. It should also be appreciated that the front cover element may be attached to the front portion 212 of the bra in multiple ways, including by stitching, Velcro, by snaps, by clips or by various other methods.

In various embodiments, certain portions of the front cover element 260 are permanently attached to the front portion of the bra 212 and others are removable to allow adjustment of the corset mechanism 20. It should also be appreciated that in various other embodiments, the front cover element 260 is permanently attached to the bra 200 and the front portion 212 is simply the inner portion of two layers of the front of the bra 200. In this embodiment, the cover element 260 is configured and sized such that the wearer can easily access and adjust the corset mechanism 20.

FIG. 10 provides a rear view of the second embodiment of bra 200. As illustrated, rather than being removably attached as in the front of the bra 200, the straps 17 in this embodiment are an extension and part of a single construction of the rear portion 216 of the bra 200. Also, notably in the embodiment of FIG. 10, the top of the rear portion 216 between straps 17 is approximately the same height as the top of the front portion 112. Further, in this embodiment, rear portion 216 includes an opening which can provide a wearer with greater flexibility when twisting or moving in various positions as well as greater breathability.

Figure 11A:
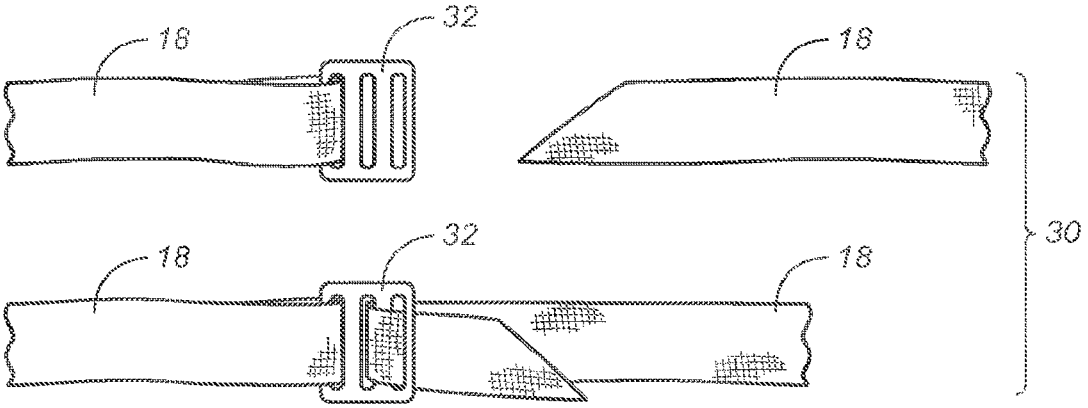
FIGS. 11A to 11G illustrate various chest band adjustment mechanisms of the various embodiments of the bra.

FIGS. 11A to 11G illustrate various chest band adjustment mechanisms 30 for the bra 10. It should be appreciated that each of these adjustment band mechanisms is equally applicable to any embodiment disclosed herein. FIG. 11A illustrates a traditional strap adjuster 32 used to tighten or loosen chest band 18, showing the strap adjuster 32 in both an engaged position with each side of the chest band 18 and in an unengaged position.

Figure 11B:
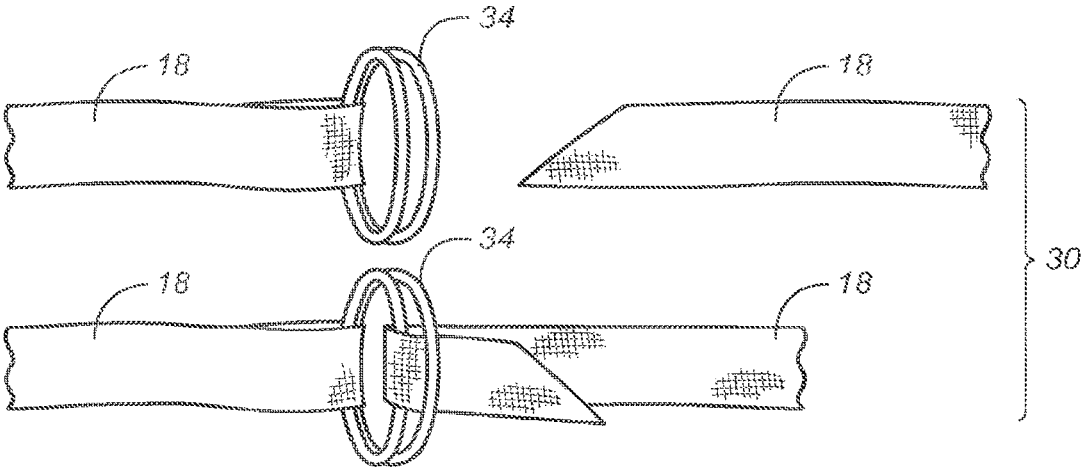

FIG. 11B shows a double ring belt structure 34 being used to tighten or loosen chest band 18, showing the double ring belt structure both unengaged with the other side of the chest band 18 and in an engaged position. It should be appreciated that the rings in such an embodiment may be circular, D-shaped or any suitable shape. It should be further appreciated that the rings in such an embodiment may be plastic, metal or any suitable material.

Figure 11C:
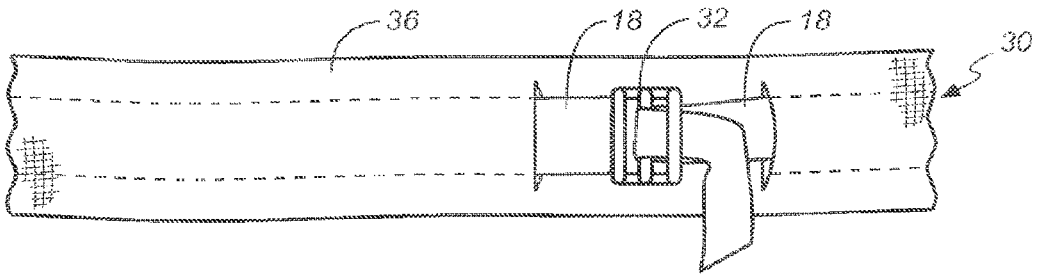

FIG. 11C specifically illustrates an embodiment in which at least a portion of chest band 18 is covered by a material or fabric 36, showing strap adjuster 32 being used to tighten or loosen chest band 18.

Figure 11D:
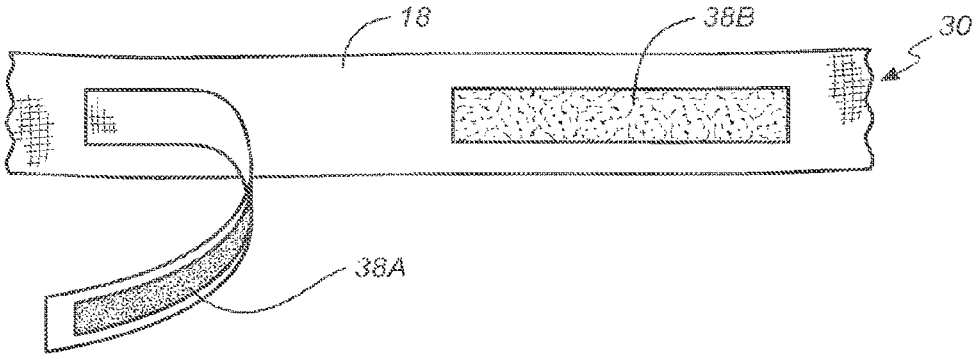

FIG. 11D illustrates opposing Velcro elements 38A and 38B that are attached to chest band 18 being used to tighten or loosen chest band 18.

Figure 11E:
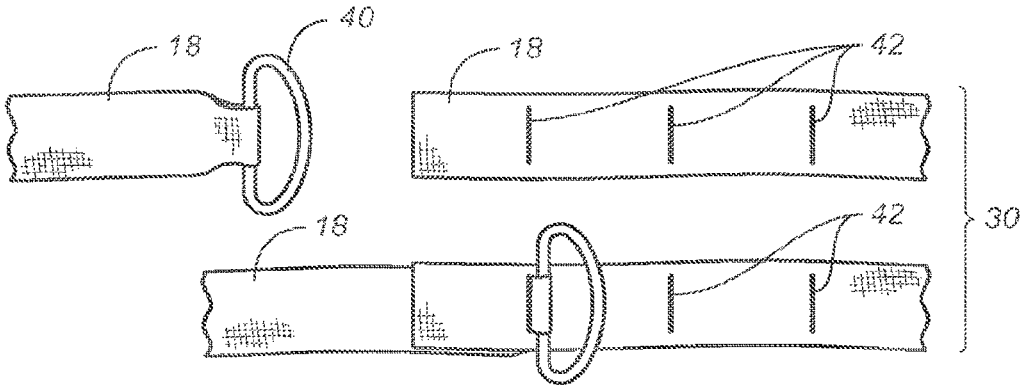

FIG. 11E illustrates the chest band 18 as having a circular ring or D-shaped element 40 attached to a first end of chest band 18. It should be appreciated that in various embodiments, ring element 40 may be any suitable shape or material, such as metal or plastic. A second end of the chest band 18 includes a plurality of slits 42. In embodiments in which the chest band 18 is composed of an elastic material, the wearer may tighten or loosen the chest band 18 by pushing the ring element 40 through various different slits 42 (each slit designating a different total length of chest band 18). FIG. 11E illustrates the element 40 not engaged with any slit 42 and also illustrates the element 40 engaged with a slit 42.

Figure 11F:
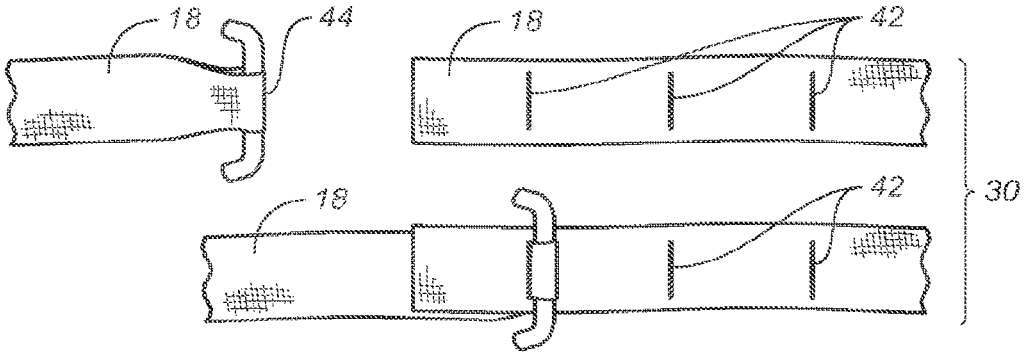

FIG. 11F illustrates a chest band adjustment mechanism similar to that of FIG. 11E, but illustrates an element 44 having the shape of a half rectangle. FIG. 11E shows adjustment element 44 both in an unengaged position relative to any slit 42 and also in an engaged position with a slit 42. It should be appreciated that in various embodiments, adjustment element 44 may be any suitable shape or material, such as metal or plastic.

Figure 11G:
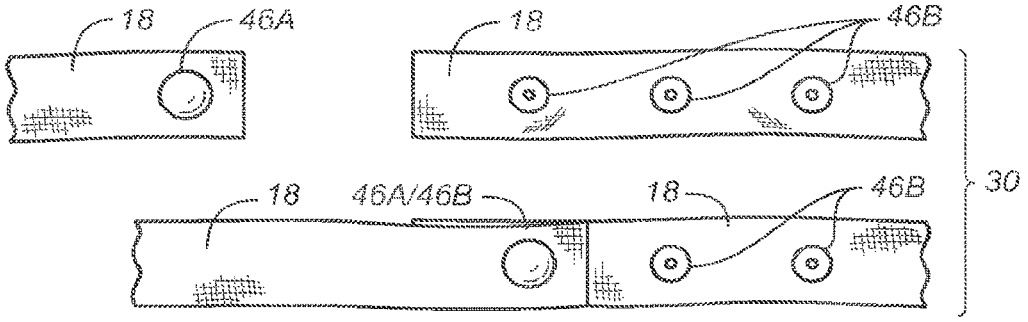

FIG. 11G illustrates the use of snaps 46A/46B to tighten or loosen chest band 18. In this embodiment, a male snap element 46A is attached to a first end of the chest band 18 and a female snap element 46B is attached to a second end of the chest band 18. In this embodiment, the female snap elements 46B are provided close enough together that minute adjustments can be made to the chest band 18 still providing for a customized fit. FIG. 11G illustrates the male element 46A not being attached to the second end of the chest band 18 and an example of the male snap element 46A being attached to a female snap element 46B.

It should be appreciated that in various embodiments, the chest band adjustment mechanism 30 may be any other suitable mechanism, such as a traditional belt having various loops, a manually tied bow, a hook-and-eye closure, a cord lock in conjunction with a cord integrated into chest band 18 or other applicable adjustment mechanisms know to those of skill in the art.

It should be appreciated that while each of the embodiments disclosed herein include a front cover portion which covers corset mechanism 20, in various embodiments, the bra need not include a front cover element and the corset mechanism and front portion immediately covering the breasts may be exposed. This results in less use of materials and weight.

Further, each of the embodiments disclosed herein include a bra that does not encapsulate the breasts (i.e., provide for a cup or shaped space for the each breast). Rather, the bras are defined to compress the breasts in accordance with the wearer's adjustments. While the embodiments disclosed herein do not include cups or encapsulated breast designs, it should be appreciated that various other embodiments of the bra having certain features disclosed herein may include cups or a configuration that encapsulates the breasts.

Various other embodiments of the bra disclosed herein may include an insert or thick fabric at or around the location of the center of each of breast to further flatten or smooth the appearance of the breast. This may assist with minimizing the appearance of the nipple area of the breast for modesty purposes.

It should be appreciated that while the disclosed bra is discussed in the context of women, the bra could also be used for men.

In various embodiments, the bra disclosed herein may also include one or more sensors or monitors. For example, various embodiments of the bra disclosed herein may include a heart rate sensor, a GPS tracker, an altimeter, a body thermometer or various other sensors or monitors. These sensors may store data in a memory device for subsequent upload, communicate with a satellite or communicate with a smart phone or other electronic device of the wearer. In various other embodiments, a memory device may be built into the bra including wearer information such as identity and medical history. This could be advantageous in the event of an accident during a physical activity. In various other embodiments, a memory device may store any suitable data.

It should be appreciated that commercial implementations of the bra disclosed herein may still be offered in standard sizes (e.g., extra small, small, medium or large), but still be adjustable. A wearer still customizes an exact size, but does so based on a reference point (their respective size). It should be appreciated that in various other embodiments, as long as there is enough margin for adjustment, the bra could be offered in a universal size (particularly since it uses a compressive force instead of encapsulation for the breasts). It should be further appreciated, that if the bra is offered in various sizes, the thickness or length of the straps could vary according to bra size.

It should be further appreciated that another advantage of the bra disclosed herein is that although elastic materials of the bra may stretch over time, the wearer can still prolong the life of their bra by continually adjusting it. While the bra may require tighter adjustment over time, the longevity of the bra is enhanced despite the stretching of material over time.

It should be appreciated that any suitable materials and manufacturing techniques may be used in constructing the bra disclosed herein including, but not limited to, Elastane (spandex), Lycra, polyesters, cotton, Elastolefin XLA™ NG, polyamide, polyamide micro, recycled polyamide, polybutylene terephthalate, polyester, polyester BIOPHYL™, recycled polyester, polypropylene, satin, tricot, mesh, silk, cotton, recycled or recovered Cotton, latex, microfiber, polyurethanes, nylon, nylon-polyamides, polyolefins, natural fibers, lace, Bemis, Sewfree® films, seamtape, heatseal adhesives, quick drying materials, bacteriostatic materials, two-way stretch materials, muscle control materials, moisture management materials, materials offering UV protection, materials offering breathability, materials offering extra comfort, hollow fibre materials, recycled yarn, brushed materials, Hydrophilic, Chlorine proof materials, feather weight materials, materials having strong shape retention properties, soft materials, non-curling materials, materials offering thermal protection, materials resistant to sun creams and oils, materials resistant to pilling, materials resistant to sand, sanitized materials or velvet. Additionally, various materials such as bone, wood, plastic and metal may be used in fasteners to stiffen the bra.

It should be appreciated that in various other embodiments, in the alternative of or in addition to a pocket, one or more velcro attachment elements maybe located on the bra to allow a wearer to removably secure various personal items such as phones, credit cards, music players, heart rate monitors, GPS trackers, or anything else the user may wish to attach.

It should be appreciated that although various embodiments herein discuss removing the straps only from the front of the bra, in various embodiments, the straps could be completely interchangeable. For example, a user may wish to vary the length, color, material or degree of cushioning of the straps for various activities. In such embodiments, the straps are removably attached at both the front and the back of the bra. However, it should be appreciated that such embodiments still offer all of the recited benefits of the invention because once the straps have been interchanged, the location of the straps (i.e., crossed or not) can still be seamlessly changed from the front of the bra.

It should further be appreciated that although in the embodiments disclosed herein each of the strap length, strap location, corset mechanism compression and chest band tightness is adjusted in the front of the bra, in various other embodiments, one or more of these components could be adjusted at a different location. For example, the chest band could be adjusted at the side of the bra in various embodiments. Additionally, in various embodiments, the straps could be fixedly attached to the front portion of the bra, and adjustment could take place from the back of the bra.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An adjustable bra comprising:

a front portion;

a rear portion;

two side portions joining the front portion and the rear portion;

at least two shoulder straps extending between the front portion and the rear portion, wherein each of the at least two shoulder straps includes a first end fixedly attached to the rear portion and a second end removably attached to the front portion, such that a wearer is enabled to detach each of the at least two shoulder straps from the front portion; and an adjustable corset mechanism disposed on the front portion, wherein the corset mechanism further comprises a cord and a cord lock configured to enable the wearer to adjust the corset mechanism at the front portion of the bra in the wearer's cleavage area to provide compressive force on the wearer's breasts.

2. The adjustable bra of claim 1, further comprising at least one chest band, the chest band extending about a perimeter of the front portion, the rear portion and the two side portions, wherein the chest band includes a chest band adjustment mechanism configured to enable the wearer to adjust the chest band at a front of the wearer.

3. The adjustable bra of claim 2, wherein the chest band adjustment mechanism is selected from the group consisting of a strap adjuster, a belt, a plastic or metal element configured to be placed through a slit that is smaller than the plastic or metal element, a hook-and-eye fastener and snaps.

4. The adjustable bra of claim 1, wherein each of the at least two shoulder straps includes a strap adjuster configured to enable the wearer to adjust the length of the strap at a front of the wearer.

5. The adjustable bra of claim 1, wherein responsive to detaching one of the at least two shoulder straps from the front portion, the wearer is enabled improved access to the wearer's breasts.

6. The adjustable bra of claim 1, further comprising a front cover element, wherein the front cover element joins a bottom of the front portion and a top of the front portion, and wherein the front cover element covers both a portion of the front portion and the adjustable corset mechanism.

7. An adjustable bra comprising:

a front portion;

a rear portion;

two side portions joining the front portion and the rear portion;

at least two shoulder straps extending between the front portion and the rear portion, wherein each of the at least two shoulder straps includes a first end fixedly attached to the rear portion and a second end removably attached to the front portion, such that a wearer is enabled to detach each of the at least two shoulder straps from the front portion; and an adjustable corset mechanism disposed on the front portion to provide compressive force on the wearer's breasts, wherein the corset mechanism further comprises a cord and a cord lock.

8. The adjustable bra of claim 7, further comprising at least one chest band, the chest band extending about a perimeter of the front portion, the rear portion and the two side portions, wherein the chest band includes a chest band adjustment mechanism configured to enable the wearer to adjust the chest band at the front of the wearer.

9. The adjustable bra of claim 8, wherein the chest band adjustment mechanism is selected from the group consisting of a strap adjuster, a belt, a plastic or metal element configured to be placed through a slit that is smaller than the plastic or metal element, a hook-and-eye fastener and snaps.

10. The adjustable bra of claim 8, wherein the chest band is configured to provide support underneath the wearer's breasts.

11. The adjustable bra of claim 7, wherein responsive to detaching each of the at least two shoulder straps from the front portion, the at least two shoulder straps are reattached to opposite ends of the front portion, such that the at least two shoulder straps form a crisscross pattern.

12. The adjustable bra of claim 7, wherein responsive to detaching one of the at least two shoulder straps from the front portion, the wearer is enabled improved access to the wearer's breasts.

13. The adjustable bra of claim 7, wherein each of the at least two shoulder straps includes a strap adjuster configured to enable the wearer to adjust the length of the strap at a front of the wearer.

14. The adjustable bra of claim 7, further including a front cover element joining a bottom of the front portion and a top of the front portion, wherein the front cover element is permanently attached to the bottom of the front portion and the top of the front portion.

15. The adjustable bra of claim 7, further including a front cover element joining a bottom of the front portion and a top of the front portion, wherein the front cover element is at least partially removable from the front portion.

16. The adjustable bra of claim 7, further including a front cover element joining a bottom of the front portion and a top of the front portion, wherein the front cover element further comprises a pocket.

17. A method of adjusting a bra comprising:

anchoring a chest band of the sports bra, wherein the sports bra includes:

a front portion, a rear portion, two side portions joining the front portion and the rear portion, at least two shoulder straps extending between the front portion and the rear portion, wherein each of the at least two shoulder straps includes a first end fixedly attached to the rear portion and a second end removably attached to the front portion, such that a wearer is enabled to detach each of the at least two shoulder straps from the front portion, and an adjustable corset mechanism disposed on the front portion;

adjusting the chest band, wherein the chest band is configured to provide support underneath the wearer's breasts;

anchoring at least two shoulder straps;

adjusting the at least two shoulder straps;

lifting a first breast inside the sports bra;

lifting a second breast inside the sports bra; and cinching the adjustable corset mechanism to compress the first breast and the second breast, wherein cinching the adjustable corset mechanism includes:

disengaging a cord lock, pulling a cord through the cord lock, and engaging the cord lock.

18. The method of claim 17, further comprising detaching one of the at least two shoulder straps from the front portion, such that the wearer is enabled improved access to the wearer's breasts.

19. The method of claim 17, wherein the chest band extends about a perimeter of the front portion, the rear portion and the two side portions, wherein the chest band includes a chest band adjustment mechanism configured to enable the wearer to adjust the chest band at the front of the wearer.

20. The method of claim 17, wherein each of the at least two shoulder straps includes a strap adjuster configured to enable the wearer to adjust the length of the strap at a front of the wearer.

* * * * *